US008978280B2

(12) United States Patent
Holt et al.

(10) Patent No.: US 8,978,280 B2
(45) Date of Patent: Mar. 17, 2015

(54) ARCHED DISPLAY

(71) Applicant: Menasha Corporation, Neenah, WI (US)

(72) Inventors: Douglas E. Holt, White Oak, PA (US); William J. Mertz, II, Greensburg, PA (US); Christopher Norman, Milwaukee, WI (US)

(73) Assignee: Menasha Corporation, Neenah, WI (US)

( * ) Notice: Subject to any disclaimer, the term of this patent is extended or adjusted under 35 U.S.C. 154(b) by 3 days.

(21) Appl. No.: 13/793,000

(22) Filed: Mar. 11, 2013

(65) Prior Publication Data

US 2013/0232836 A1 Sep. 12, 2013

Related U.S. Application Data

(60) Provisional application No. 61/609,695, filed on Mar. 12, 2012.

(51) Int. Cl.

| | |
|---|---|
| ***G09F 15/00*** | (2006.01) |
| ***G09F 23/06*** | (2006.01) |
| ***G09F 1/06*** | (2006.01) |

(52) U.S. Cl.

CPC ..... *G09F 15/00* (2013.01); *G09F 15/0056* (2013.01); *G09F 23/06* (2013.01); *G09F 1/06* (2013.01)

USPC ..... 40/610

(58) Field of Classification Search

USPC ..... 40/538, 539, 605, 610; 211/183, 189

See application file for complete search history.

(56) References Cited

U.S. PATENT DOCUMENTS

| | | | |
|---|---|---|---|
| 1,827,008 | A | 10/1931 | Huckel |
| 1,912,847 | A | 6/1933 | Earl |
| 1,992,373 | A | 2/1935 | Johnson |
| 2,018,707 | A | 10/1935 | Daller |
| D104,437 | S | 5/1937 | Bulman |
| 2,339,656 | A | 1/1944 | Shina |
| D146,386 | S | 2/1947 | Shield |
| D153,188 | S | 3/1949 | Stensgaard |

(Continued)

FOREIGN PATENT DOCUMENTS

| | | |
|---|---|---|
| EP | 0629557 A1 | 12/1994 |
| JP | 06278746 | 10/1994 |

OTHER PUBLICATIONS

LeBlanc, Rick; "Limits on Export Pallets Creating Corrugated Window of Opportunity; Corrugated Pallet Suppliers Experiencing Renewed Interest for Export, Domestic Markets"; http://www.palletenterprise.com/articledatabase/view.asp?articleID=648; 7 pages; Apr. 1, 2002.

(Continued)

*Primary Examiner* — Charles A Fox
*Assistant Examiner* — Christopher E Veraa
(74) *Attorney, Agent, or Firm* — Nixon Peabody LLP

(57) ABSTRACT

In an embodiment of the present invention, an arched display unit is provided. The unit includes a pair of display mounts, and a display support attached to each of the pair of display mounts. A side header is attached to each of the display supports, and a center header is located between the pair of side headers. In another embodiment, each of the display mounts, display supports, side headers, and center header are formed from a single blank of corrugated material, such as cardboard or plastic.

24 Claims, 8 Drawing Sheets

(56) References Cited

U.S. PATENT DOCUMENTS

| | | | | | |
|---|---|---|---|---|---|
| D158,775 | S | | 5/1950 | Malkin | |
| D158,776 | S | | 5/1950 | Malkin | |
| 2,706,066 | A | | 4/1955 | Wells | |
| 2,798,685 | A | | 7/1957 | Mooney | |
| 2,944,555 | A | | 7/1960 | Peel et al. | |
| 2,975,890 | A | | 3/1961 | Block | |
| 3,000,602 | A | | 9/1961 | O'Brien | |
| 3,026,015 | A | | 3/1962 | Severn | |
| 3,026,078 | A | | 3/1962 | Simkins | |
| 3,058,646 | A | | 10/1962 | Guyer | |
| 3,161,341 | A | | 12/1964 | Farquhar | |
| D204,434 | S | | 4/1966 | Kingsford | |
| 3,480,196 | A | | 11/1969 | Simas | |
| 3,528,559 | A | | 9/1970 | Miller | |
| 3,690,118 | A | | 9/1972 | Rainwater | |
| 3,696,990 | A | | 10/1972 | Dewhurst | |
| 3,730,417 | A | | 5/1973 | Lawson | |
| 3,857,494 | A | | 12/1974 | Giardini | |
| 3,879,053 | A | | 4/1975 | Chvala | |
| 3,886,348 | A | | 5/1975 | Jonathan et al. | |
| 3,944,128 | A | | 3/1976 | Hogan | |
| D239,805 | S | | 5/1976 | South | |
| 4,004,691 | A | | 1/1977 | Wihksne | |
| D244,117 | S | | 4/1977 | Naylor | |
| 4,085,847 | A | | 4/1978 | Jacalone | |
| 4,099,813 | A | | 7/1978 | Olivan | |
| 4,171,741 | A | | 10/1979 | Fish | |
| 4,283,000 | A | | 8/1981 | White | |
| 4,292,901 | A | | 10/1981 | Cox | |
| 4,375,874 | A | | 3/1983 | Leotta et al. | |
| 4,376,558 | A | | 3/1983 | Bandar | |
| 4,488,652 | A | * | 12/1984 | Hinton et al. | 211/183 |
| 4,503,973 | A | | 3/1985 | Andersson | |
| D278,493 | S | | 4/1985 | Brescia et al. | |
| 4,602,735 | A | | 7/1986 | Aaron | |
| 4,610,355 | A | | 9/1986 | Maurer | |
| 4,618,115 | A | | 10/1986 | Belokin, Jr. | |
| 4,655,352 | A | * | 4/1987 | Noyes et al. | 211/175 |
| 4,658,984 | A | | 4/1987 | Brunner | |
| 4,673,092 | A | | 6/1987 | Lamson et al. | |
| 4,688,716 | A | | 8/1987 | Winterling | |
| D292,659 | S | | 11/1987 | Svezia et al. | |
| D293,520 | S | | 1/1988 | Ovitz, III | |
| 4,722,473 | A | | 2/1988 | Sandrini et al. | |
| D294,908 | S | | 3/1988 | Childress | |
| 4,765,492 | A | | 8/1988 | Howard et al. | |
| 4,791,740 | A | * | 12/1988 | Ferrari | 40/124 |
| 4,793,664 | A | | 12/1988 | Jackson | |
| 4,826,265 | A | | 5/1989 | Hockenberry | |
| 4,836,379 | A | | 6/1989 | Shaw | |
| 4,850,284 | A | | 7/1989 | DeGroot et al. | |
| 4,852,756 | A | | 8/1989 | Holladay | |
| 4,863,024 | A | | 9/1989 | Booth | |
| 4,871,067 | A | | 10/1989 | Valenti | |
| 4,877,137 | A | | 10/1989 | Govang et al. | |
| 4,911,084 | A | | 3/1990 | Sato et al. | |
| 4,936,470 | A | | 6/1990 | Prindle | |
| D321,100 | S | | 10/1991 | Dorrell | |
| D321,295 | S | | 11/1991 | Nuebler | |
| D321,615 | S | | 11/1991 | Lavine et al. | |
| 5,067,418 | A | | 11/1991 | Carter | |
| 5,119,740 | A | | 6/1992 | Carter | |
| 5,125,520 | A | | 6/1992 | Kawasaki | |
| 5,176,265 | A | | 1/1993 | Bennett | |
| D332,883 | S | | 2/1993 | Staude | |
| 5,195,440 | A | | 3/1993 | Gottlieb | |
| 5,213,220 | A | | 5/1993 | McBride | |
| 5,259,631 | A | | 11/1993 | Brande | |
| 5,269,219 | A | | 12/1993 | Juvik-Woods | |
| 5,272,990 | A | | 12/1993 | Carter | |
| D349,202 | S | | 8/1994 | Eliades et al. | |
| D351,076 | S | | 10/1994 | Eliades et al. | |
| 5,357,875 | A | | 10/1994 | Winebarger et al. | |
| 5,388,531 | A | | 2/1995 | Crews et al. | |
| 5,413,053 | A | | 5/1995 | Vannatta | |
| 5,427,019 | A | | 6/1995 | Moorman | |
| D362,768 | S | | 10/1995 | Lechleiter et al. | |
| D363,840 | S | | 11/1995 | Weshler | |
| 5,465,672 | A | | 11/1995 | Boyse et al. | |
| 5,487,344 | A | | 1/1996 | Hutchinson | |
| 5,487,345 | A | | 1/1996 | Winebarger et al. | |
| D369,035 | S | | 4/1996 | Potter | |
| D369,043 | S | | 4/1996 | Parker | |
| 5,520,120 | A | | 5/1996 | Badger | |
| 5,528,994 | A | | 6/1996 | Iseli | |
| 5,540,536 | A | | 7/1996 | Hoedl | |
| 5,543,205 | A | | 8/1996 | Liebel | |
| 5,590,606 | A | | 1/1997 | Crews et al. | |
| 5,603,258 | A | | 2/1997 | Besaw | |
| 5,622,306 | A | | 4/1997 | Grigsby et al. | |
| 5,672,412 | A | | 9/1997 | Phares et al. | |
| 5,685,234 | A | | 11/1997 | Grigsby et al. | |
| D388,905 | S | | 1/1998 | Wells | |
| 5,706,953 | A | | 1/1998 | Polvere | |
| 5,711,423 | A | | 1/1998 | Fuller, Jr. | |
| D395,534 | S | | 6/1998 | Besaw | |
| 5,762,213 | A | | 6/1998 | Heneveld, Sr. | |
| 5,791,487 | A | | 8/1998 | Dixon | |
| 5,794,542 | A | | 8/1998 | Besaw | |
| 5,797,499 | A | | 8/1998 | Pinco | |
| D398,461 | S | | 9/1998 | Baluk et al. | |
| D398,462 | S | | 9/1998 | Baluk et al. | |
| 5,809,903 | A | | 9/1998 | Young, Jr. | |
| 5,816,172 | A | | 10/1998 | Carter | |
| 5,826,732 | A | | 10/1998 | Ragsdale | |
| 5,832,841 | A | | 11/1998 | Crews et al. | |
| 5,881,652 | A | | 3/1999 | Besaw | |
| D412,253 | S | | 7/1999 | Brozak, Jr. | |
| 5,918,744 | A | | 7/1999 | Bringard et al. | |
| 5,950,914 | A | | 9/1999 | Dunton et al. | |
| 5,980,008 | A | | 11/1999 | Stoever | |
| 5,996,366 | A | | 12/1999 | Renard | |
| 5,996,510 | A | | 12/1999 | Harpman et al. | |
| D419,275 | S | | 1/2000 | Carter | |
| D419,744 | S | | 1/2000 | Carter | |
| 6,012,399 | A | | 1/2000 | Carter | |
| 6,070,726 | A | | 6/2000 | Graham | |
| 6,076,475 | A | | 6/2000 | Kuhn et al. | |
| D428,738 | S | | 8/2000 | Brozak, Jr. | |
| 6,126,131 | A | | 10/2000 | Tietz | |
| 6,135,030 | A | | 10/2000 | Besaw | |
| D433,782 | S | | 11/2000 | Carter | |
| D433,839 | S | | 11/2000 | Culbertson | |
| 6,145,671 | A | | 11/2000 | Riga et al. | |
| 6,164,215 | A | | 12/2000 | Cook et al. | |
| 6,189,778 | B1 | | 2/2001 | Kanter | |
| D453,057 | S | | 1/2002 | Sewell | |
| 6,354,229 | B1 | | 3/2002 | Heidtke | |
| 6,357,587 | B1 | | 3/2002 | Melms, Jr. | |
| 6,394,003 | B1 | | 5/2002 | Lacy, III | |
| D461,334 | S | | 8/2002 | Johnson et al. | |
| D464,498 | S | | 10/2002 | Riga et al. | |
| 6,510,982 | B2 | | 1/2003 | White et al. | |
| 6,585,118 | B2 | | 7/2003 | Kellogg | |
| 6,612,247 | B1 | | 9/2003 | Pistner et al. | |
| 6,659,295 | B1 | | 12/2003 | De Land et al. | |
| 6,715,623 | B2 | | 4/2004 | Broerman | |
| 6,729,484 | B2 | | 5/2004 | Sparkowski | |
| 6,769,368 | B2 | | 8/2004 | Underbrink et al. | |
| D495,901 | S | | 9/2004 | Bosman | |
| 6,814,245 | B2 | | 11/2004 | Leclerc et al. | |
| 6,902,074 | B2 | | 6/2005 | Albrecht | |
| 6,905,021 | B2 | | 6/2005 | Polumbaum et al. | |
| D509,382 | S | | 9/2005 | Raile | |
| 6,951,300 | B2 | | 10/2005 | Caille et al. | |
| D521,275 | S | | 5/2006 | Dusenberry | |
| 7,036,196 | B2 | | 5/2006 | Salatin et al. | |
| 7,066,342 | B2 | | 6/2006 | Baechle et al. | |
| 7,066,380 | B2 | | 6/2006 | Blake | |
| 7,089,872 | B2 | | 8/2006 | Wintermute, II et al. | |
| 7,111,735 | B2 | | 9/2006 | Lowry | |
| 7,137,517 | B2 | | 11/2006 | Lowry et al. | |
| D533,734 | S | | 12/2006 | Campbell | |
| 7,191,906 | B1 | | 3/2007 | Pinco | |

(56) References Cited

U.S. PATENT DOCUMENTS

| | | | |
|---|---|---|---|
| 7,234,604 | B2 | 6/2007 | Eisele |
| D566,989 | S | 4/2008 | Mason |
| D576,426 | S | 9/2008 | Yuen-Schat et al. |
| D578,804 | S | 10/2008 | Norman et al. |
| 7,546,926 | B2 | 6/2009 | Stolle et al. |
| 7,546,927 | B2 | 6/2009 | Lowry et al. |
| D603,189 | S | 11/2009 | Raile |
| 7,650,996 | B2 | 1/2010 | Mark |
| 7,677,433 | B2 | 3/2010 | Little |
| 7,703,665 | B2 | 4/2010 | McGowan |
| 7,703,864 | B2 | 4/2010 | Moser |
| 7,717,265 | B2 | 5/2010 | Honkawa et al. |
| 7,726,474 | B2 | 6/2010 | Berger et al. |
| 7,828,169 | B2 | 11/2010 | Robinson et al. |
| 7,992,716 | B2 | 8/2011 | Jackson |
| 8,002,171 | B2 | 8/2011 | Ryan et al. |
| 8,141,713 | B2 | 3/2012 | Farkas et al. |
| 8,317,039 | B2 | 11/2012 | Norman |
| 2002/0189507 | A1 | 12/2002 | Benner |
| 2003/0042828 | A1 | 3/2003 | Bonin |
| 2003/0111383 | A1 | 6/2003 | Qiu et al. |
| 2005/0252872 | A1 | 11/2005 | Eisele |
| 2006/0006096 | A1 | 1/2006 | Funk |
| 2006/0283775 | A1 | 12/2006 | Mark |
| 2007/0193479 | A1 | 8/2007 | Slaats |
| 2009/0107940 | A1 | 4/2009 | Norman et al. |
| 2009/0127150 | A1 | 5/2009 | Meers |
| 2010/0133215 | A1 | 6/2010 | Norman |
| 2011/0000955 | A1 | 1/2011 | Manteufel et al. |
| 2011/0049072 | A1 | 3/2011 | Dewhurst |
| 2011/0266177 | A1 | 11/2011 | Lowry et al. |
| 2012/0074037 | A1 | 3/2012 | Orischak et al. |
| 2013/0097903 | A1 | 4/2013 | Gerstner |

OTHER PUBLICATIONS

"Solid Wood Packing Materials to Argentina"; http://www.corrugatedprices.com/pallets/swang.html; 2 pages; Feb. 5, 2002. Note: Applicants were unable to locate a copy of this reference; however, they believe that a copy is available to the Examiner in the application file for U.S. Appl. No. 12/621,221 at the U.S. Patent and Trademark Office.

* cited by examiner

ARCHED DISPLAY

CROSS-REFERENCE TO RELATED APPLICATIONS

The present application claims the benefit of U.S. Provisional Application No. 61/609,695 filed Mar. 12, 2012, the contents of which are incorporated herein by reference.

FEDERALLY SPONSORED RESEARCH OR DEVELOPMENT

N/A

TECHNICAL FIELD

The present invention generally relates to a display system, in the form of an arch that spans a first merchandise stand or shelving system to a second merchandise stand or shelving system.

BACKGROUND OF THE INVENTION

A large variety of displays are used in a store setting to draw a customer's attention to particular merchandise for sale or to provide other related information or guidance. It is sometimes difficult to install or utilize some of these systems with the store's shelving or merchandise holding stands. Moreover, it is sometimes difficult to easily position such displays where they can be easily viewed or optimally draw a customer's attention. The present invention provides a display system that draws a customer's attention.

SUMMARY OF THE INVENTION

In an embodiment of the present invention, an arched display unit is provided. The unit includes a pair of display mounts, and a display support attached to each of the pair of display mounts. A side header is attached to each of the display supports, and a center header is located between the pair of side headers. In another embodiment, each of the display mounts, display supports, side headers, and center header are formed from a single blank of corrugated material, such as cardboard or plastic.

BRIEF DESCRIPTION Of THE DRAWINGS

To understand the present invention, it will now be described by way of example, with reference to the accompanying drawings in which.

DETAILED DESCRIPTION

Figure 1:
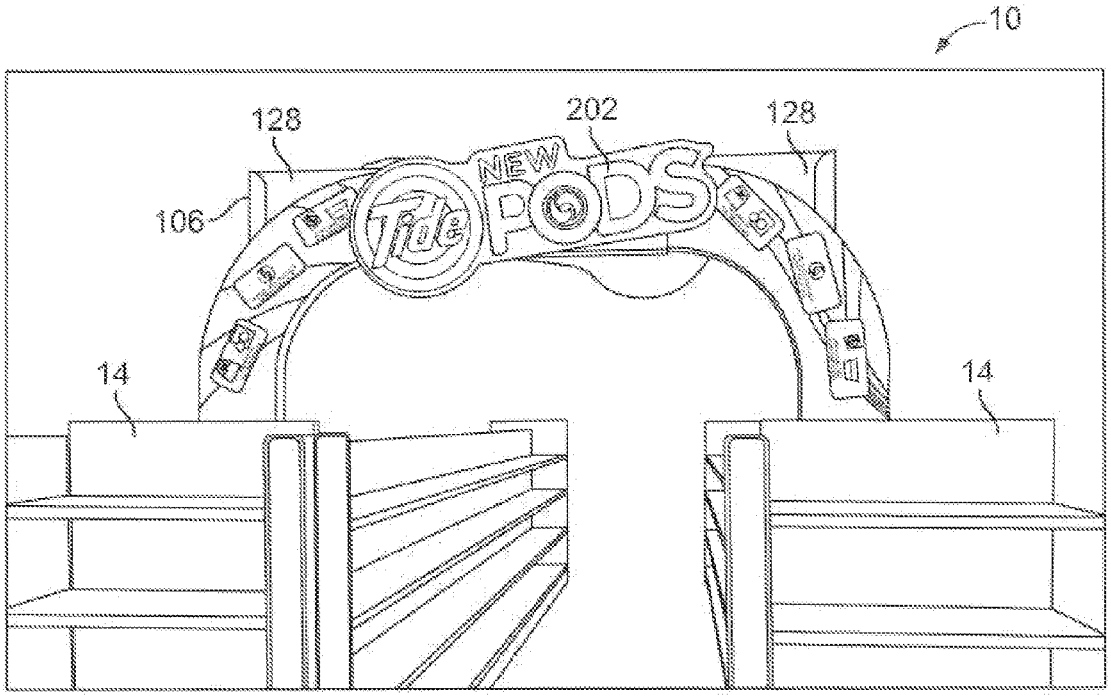
FIG. 1 is a perspective view of an arched display unit in accord with an embodiment of the present invention.

While this invention is susceptible of embodiments in many different forms, there is shown in the drawings and will, herein be described in detail preferred embodiments of the invention with the understanding that the present disclosure is to be considered as an exemplification of the principles of the invention and is not intended to limit the broad aspect of the invention to the embodiments illustrated.

Figure 11:
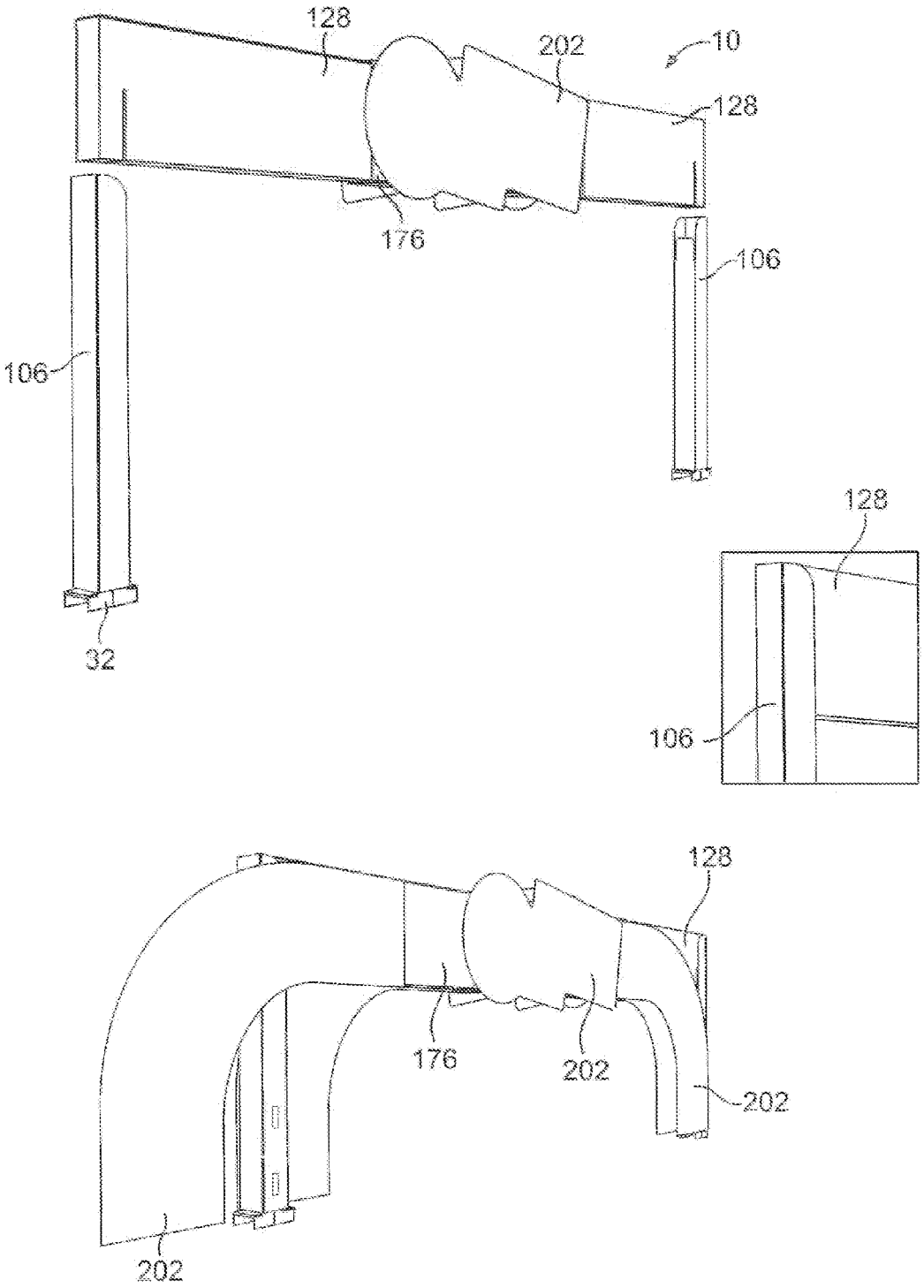
FIG. 11 is a schematic showing assembly of an arched display unit in accord with an embodiment of the present invention.

Referring to the Figures, an arch display unit 10 of an embodiment of the present invention is shown (FIGS. 1 and 11). The unit 10 includes mounting brackets 12, display mounts 32, display supports 106, side headers 128, and a center header 176. The unit 10 also includes one or more indicia panels 202 attached to the display supports 106, side headers 128, and/or center header 176. The unit 10 is preferably made of a corrugated cardboard material. Alternatively, the unit 10 can be made of a corrugated plastic or other suitable material.

Figure 2:
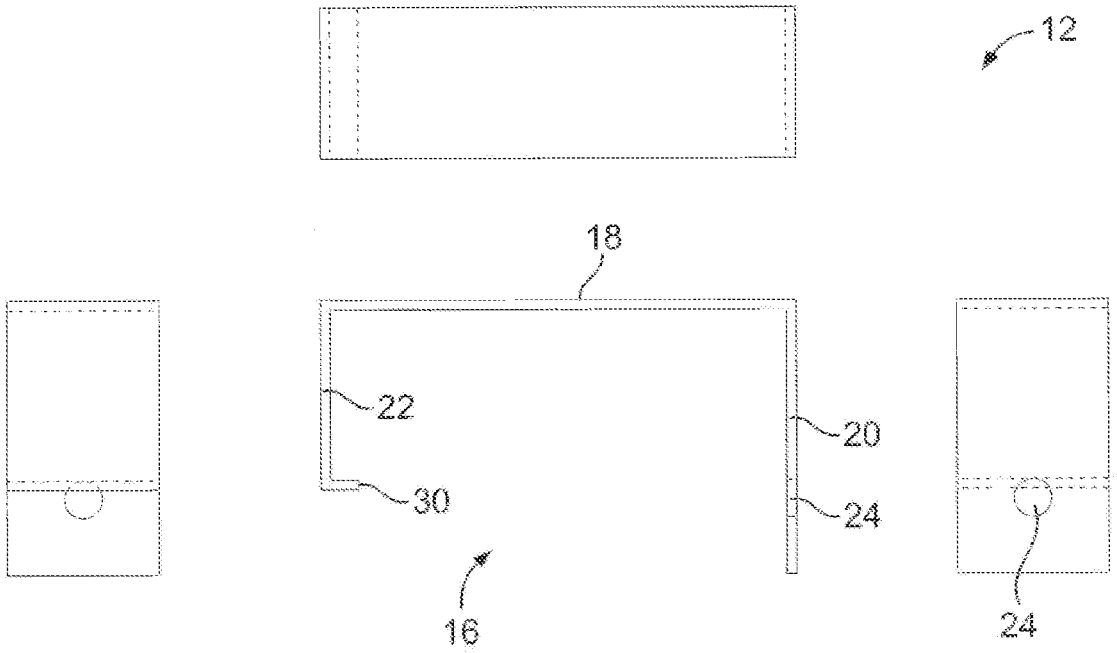
FIG. 2 is a plan view of a mounting bracket in accord with an embodiment of the present invention.
Figure 2:
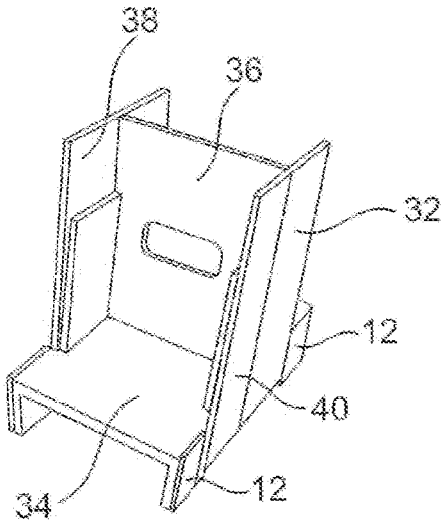
Figure 10:
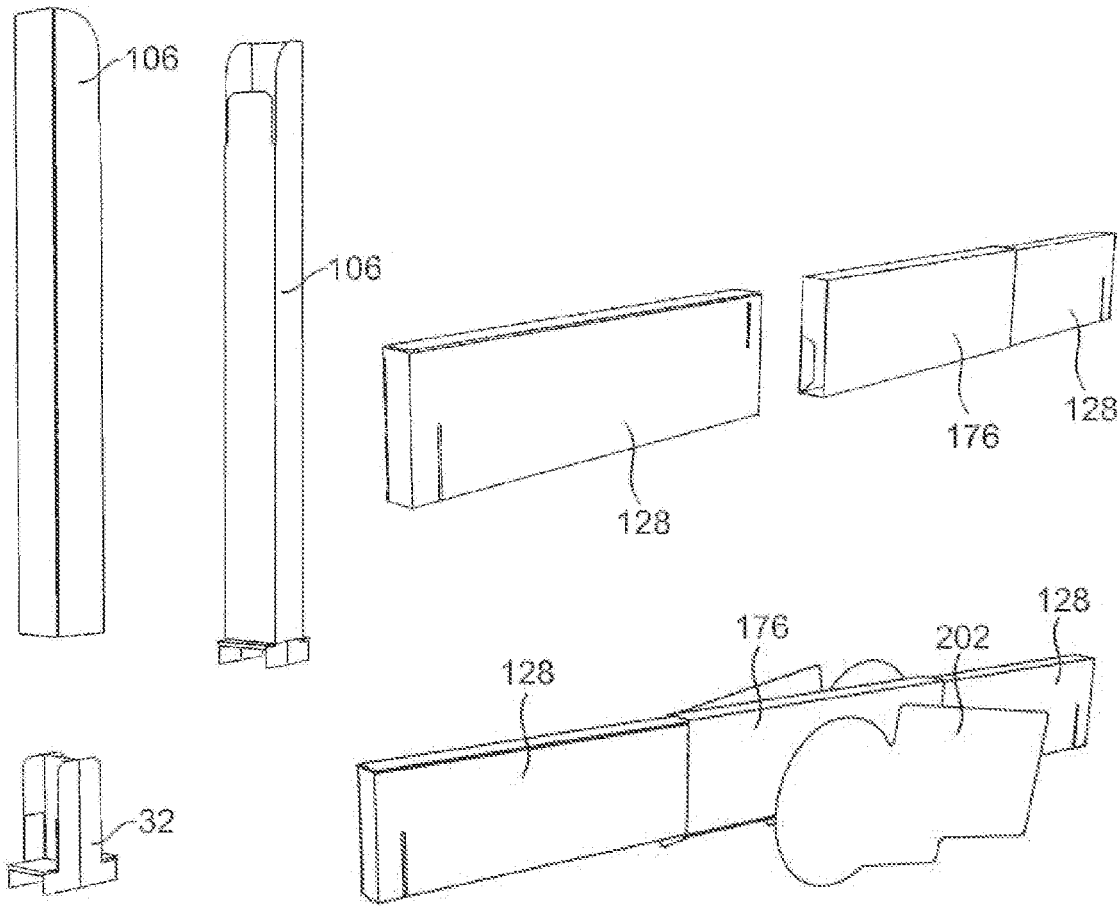
FIG. 10 is a schematic showing assembly of an arched display unit in accord with an embodiment of the present invention.
Figure 10:
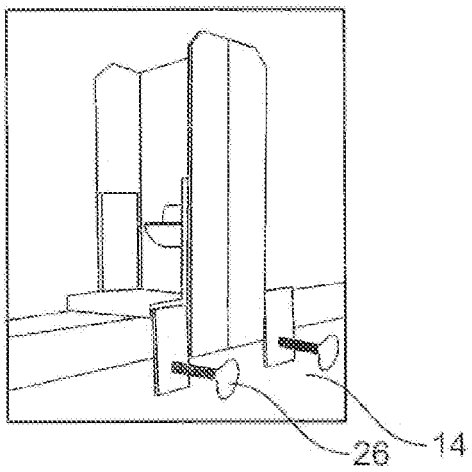

The mounting bracket 12 attaches to shelving unit 14 or other similar structure (FIGS. 2 and 10). The mounting bracket 12 includes a base 16. The base 16 has a horizontal portion 18 and downward first and second vertical portions 20 and 22 at opposing sides of the base 16. The first vertical portion 20 includes a drilled and tapped hole 24. The hole 24 is adapted to accommodate a thumb screw 26. Thumb screw 26 secures the mounting bracket 12 to the shelving unit 14. The second vertical portion 22 has an inward projection 30 at its distal end opposite the horizontal portion 18. It is contemplated two mounting brackets 12 are used in accord with an embodiment of the present invention.

A display mount 32 cooperates with the pair of mounting brackets 12. The display mount 32 includes a base 34. Integral with the base 34 is a center portion 36 and first and second sides 38 and 40.

Figure 3:
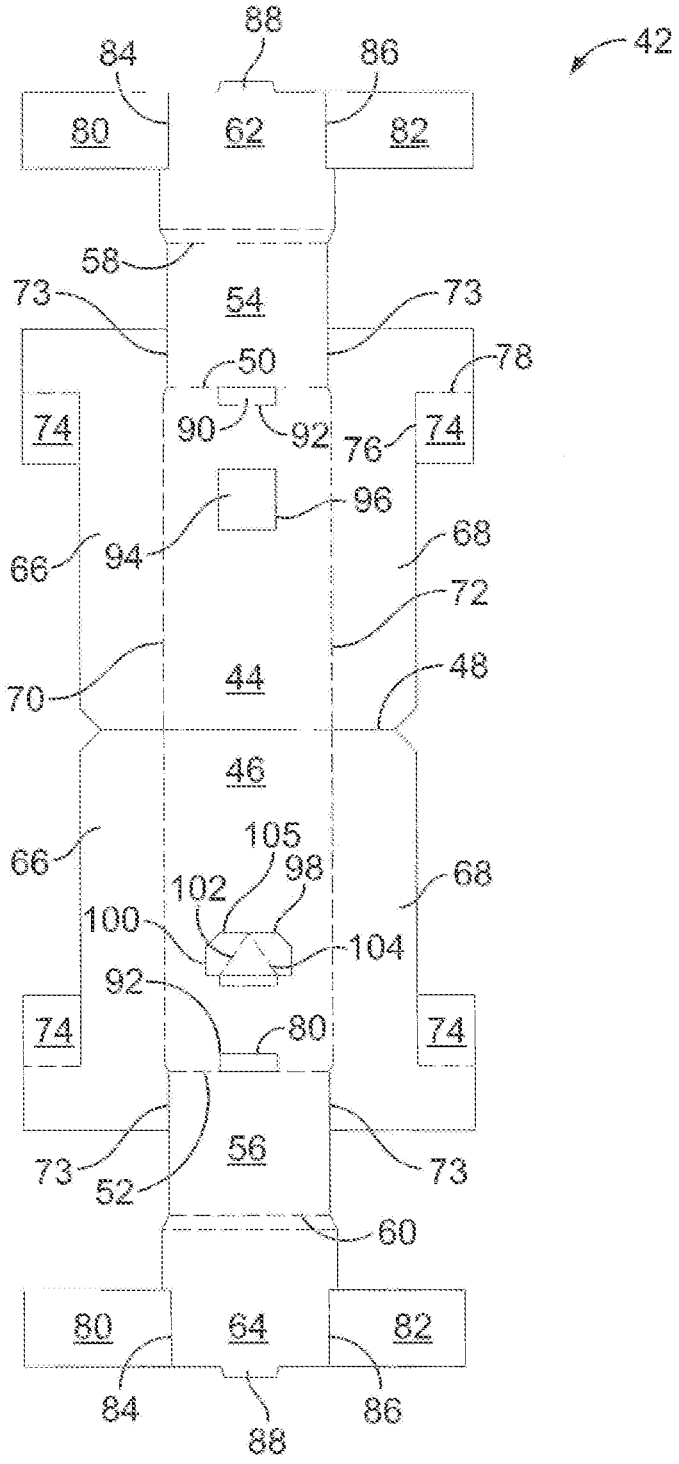
FIG. 3 is a plan view of blank used to construct a display mount in accord with an embodiment of the present invention.

The display mount 32 is formed from a single blank 42 of corrugated material (FIG. 3). The blank 42 includes a first center panel 44 and a second center panel 46. The first and second center panels 44 and 46 are joined at fold line 48. Attached to each of the first and second center panels 44 and 46 along fold lines 50 and 52 are bottom first and second base panels 54 and 56, respectively. Attached to each of the first and second base panels 54 and 56 along fold lines 58 and 60 are top first and second base panels 62 and 64.

The first and second center panels 44 and 46 each include side panels 66 and 68 attached thereto along fold lines 70 and 72 and cut lines 73. Flaps 74 are integral with the first and second center panels 44 and 46, and are formed by perforation lines 76 and fold lines 78.

Top first and second base panels 62 and 64 each include first and second side panels 80 and 82 attached thereto along fold lines 84 and 86. Top first and second base panels 62 and 64 also each include at their free ends tabs 88.

The first and second center panels 44 and 46 also each have generally rectangular first cutouts 90 formed along cut lines 92 to accept tabs 88 when the blank 42 is folded to form display mount 32. The first center panel 44 includes a generally rectangular second cutout 94 formed along cut lines 96. Second center panel 46 includes a generally trapezoidal shaped cutout 98 formed along cut lines 100 and fold lines 102 and 104 to form a second tab 105.

Figure 4:
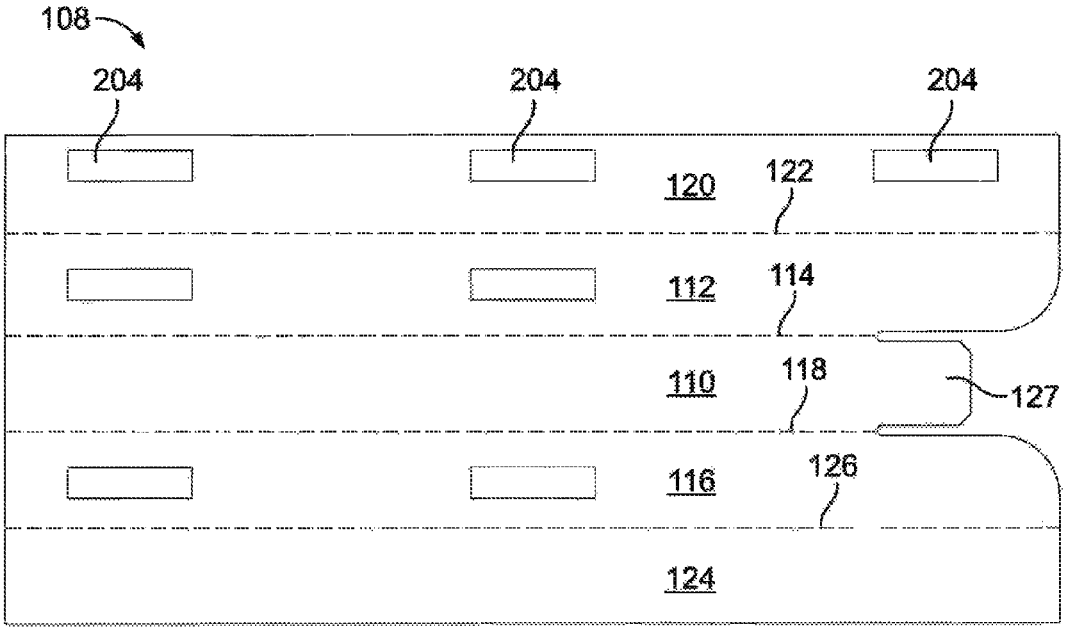
FIG. 4 is a plan view of blank used to construct a display support in accord with an embodiment of the present invention.

The display support 106 is formed from a single blank 108 of corrugated material (FIG. 4). The blank 108 includes a first panel 110. A second panel 112 is attached to one side of the first panel 110 along fold line 114. A third panel 116 is attached to the other side of the first panel 110 along fold line 118. A fourth panel 120 is attached to the second panel 112 along fold line 122. A fifth panel 124 is attached to the third panel 116 along fold line 126. Each panel is generally rectangular. The first panel 110 is shorter than the other panels and includes a tab 127 at one end.

Figure 5:
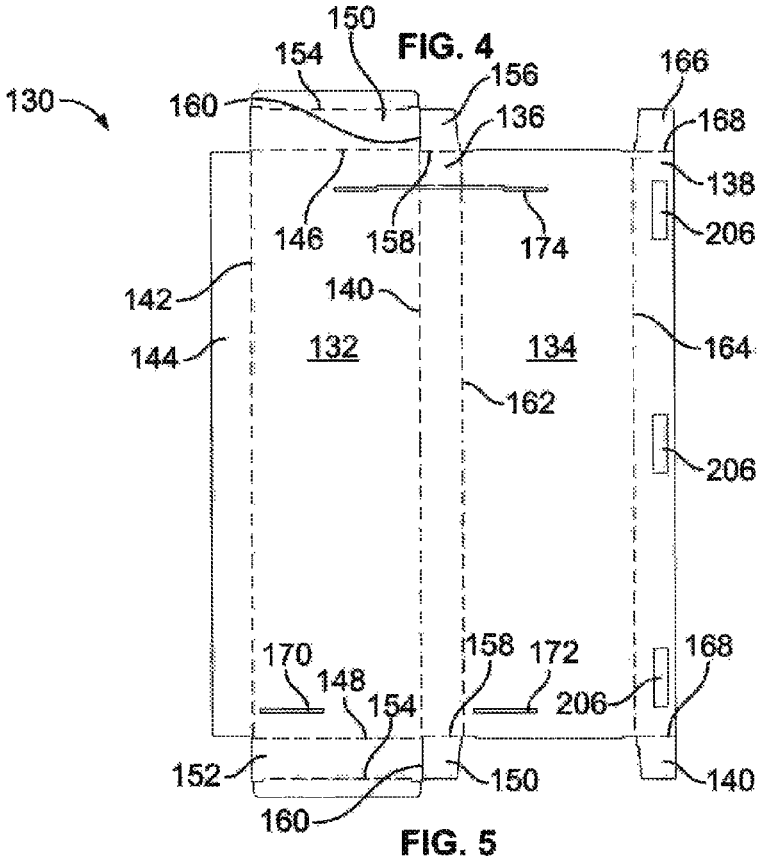
FIG. 5 is a plan view of blank used to construct a side header in accord with an embodiment of the present invention.

The side headers 128 are formed from a single blank 130 of corrugated material (FIG. 5). The blank 130 includes first and second side panels 132 and 134, and first and second end panels 136 and 138. First side panel 132 is attached to the first end panel 136 along fold line 140. Attached to the first side panel 132 along fold line 142 opposite first end panel 136 is a first flap 144. Also attached to the first side panel 132 at opposing ends along fold lines 146 and 148 are second and third flaps 150 and 152. Second and third flaps 150 and 152 each have fold lines 154.

First end panel 136 includes flaps 156 attached along fold lines 158. Flaps 156 are also detachably attached to the second and third flaps 150 and 152 along cut lines 160. The second side panel 134 is attached to the first end panel 136 along fold line 162. The second end panel 138 is attached to the second side panel 134 along fold line 164. The second end panel 138 includes flaps 166 attached thereto along fold lines 168. The blank 130 also includes thin short cutouts 170, 172, and a thin long cutout 174.

Figure 6:
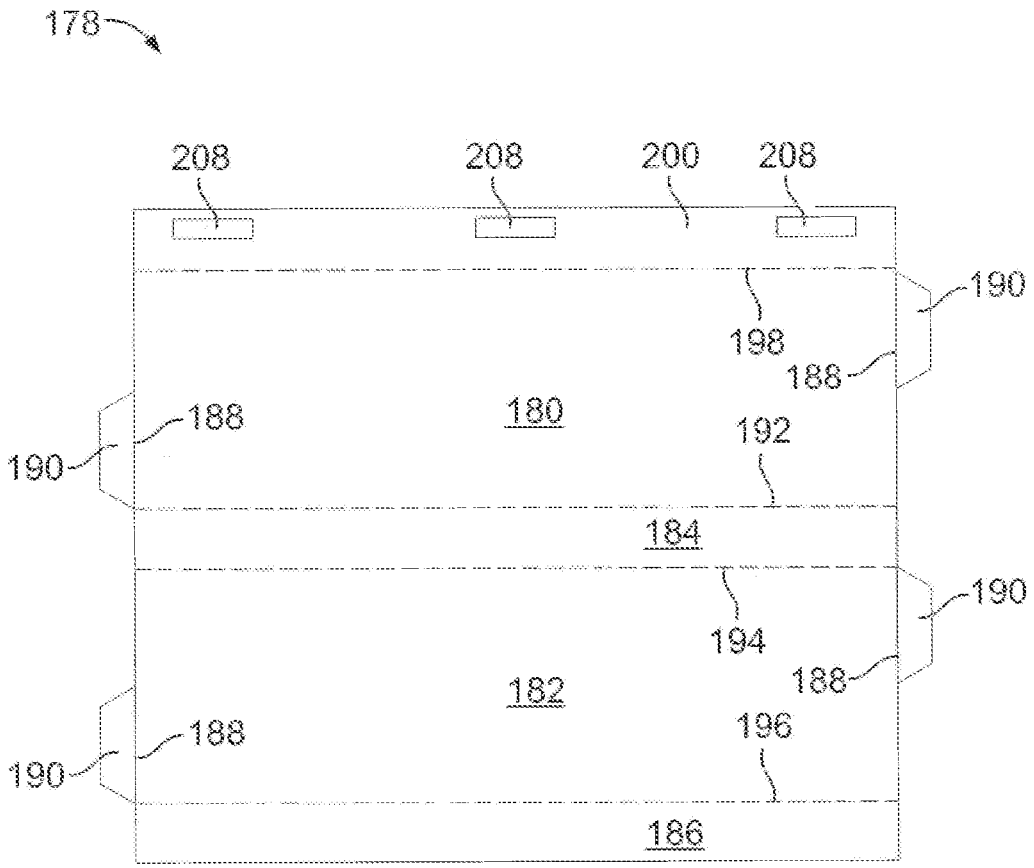
FIG. 6 is a plan view of blank used to construct a center header in accord with an embodiment of the present invention.

The center header 176 is formed from a single blank of material 178 (FIG. 6). The blank 178 includes first and second side panels 180 and 182, and first and second end panels 184 and 186. Attached along fold lines 188 to the first and second side panels 180 and 182 at opposing ends are tabs 190. The first end panel 182 is attached to the first side panel 180 along fold line 192. The second side panel 182 is attached to the first end panel 182 opposite the first side panel 180 along fold line 194. The second end panel 186 is attached to the second side panel 182 opposite the first end panel 182 along fold line 196. Attached to the first side panel 180 opposite the first end panel 184 along fold line 198 is flap 200.

Figure 7:
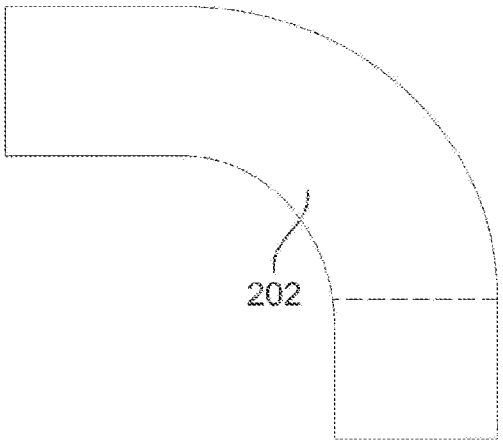
FIG. 7 is a plan view of a first indicia panel in accord with an embodiment of the present invention.
Figure 8:
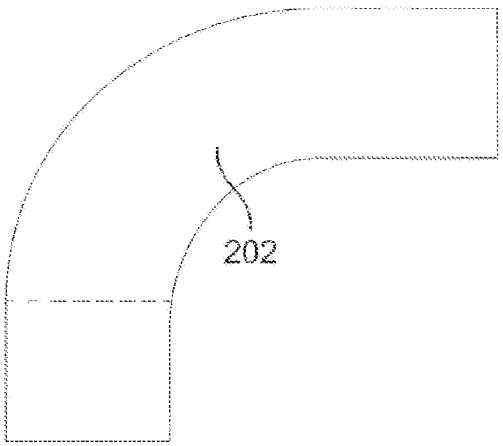
FIG. 8 is a plan view of a second indicia panel in accord with an embodiment of the present invention.
Figure 9:
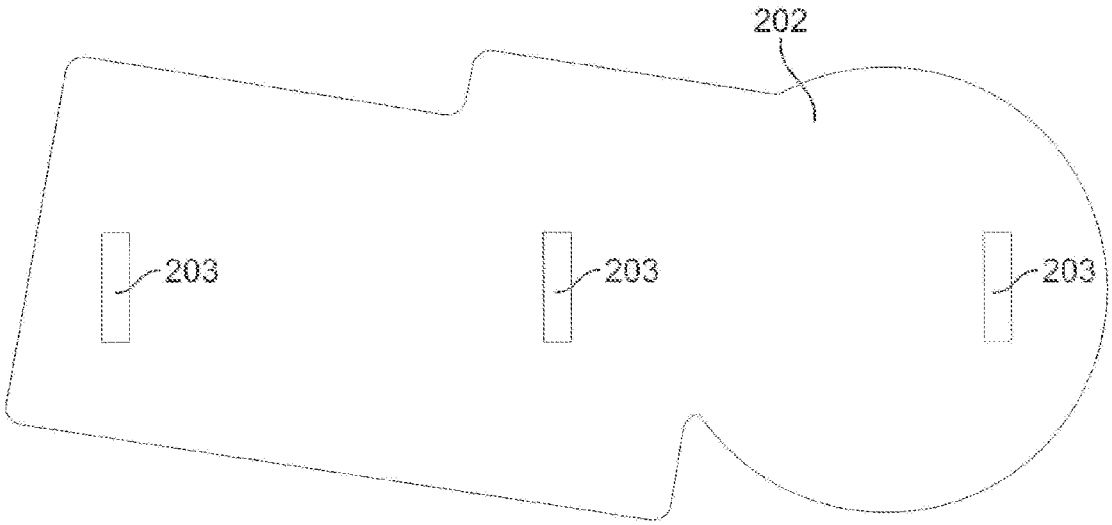
FIG. 9 is a plan view of a third indicia panel in accord with an embodiment of the present invention.

Indicia panels 202 (FIGS. 7 through 9) can include any desired indicia such as promotional materials, pricing information for products, or any other indicia. Indicia panels 202 can be attached to one or more of the display supports 106, side headers 128, or center header 176. In one embodiment the indicia panels 202 are attached using double-sided foam tape 203.

To construct the display mount 32 from the blank 42, the first and second center panels 44 and 46 are folded along fold line 48 such that they abut each other. Bottom first and second base panels 54 and 56 and top first and second base panels 62 and 64 are folded upwards along fold lines 50, 52, 58, and 60. First and second side panels 80 and 82 are folded upward along fold lines 84 and 86. Side panels 66 and 68 are folded inwards along fold lines 70 and 72, as are flaps 74 along fold lines 78. A mounting bracket 12 is placed between the top and bottom first base panels 54 and 62 and top and bottom second base panels 56 and 64. Flaps 74 are placed between the top and bottom first and second base panels 54 and 62, and 56 and 64. Tab 88 is inserted into slot 90. Cutout 98 is folded along fold lines 102 and 104 and inserted into rectangular cutout 94 to form second tab 105.

To construct the display supports 106 from the blank 108, double-sided foam tape 204 is placed at intervals on the second, third, and fourth panels 112, 116, and 120 as shown in FIG. 4. The second, third, fourth and fifth panels 112, 116, 120, and 124 are folded upwards along fold lines 114, 118, 122, and 126 until the third and fifth panels 116 and 124 overlap. The third and fifth panels 116 and 124 are attached using tape 204.

To construct the side headers 128 from the blank 120, double-sided tape 206 is placed at several points along the second end panel 138. The first and second side panels 132 and 134, first and second end panels 136 and 138, and first flap 144 are folded upwards along fold lines 140, 142, 162, and 164. First flap 144 is folded under second end panel 138 and connected thereto using tap 206. Flaps 156 and 166 are folded inwards along fold lines 158 and 168. Second and third flaps 150 and 152 are folded inwards along fold lines 146, 148, and 154 to enclose the ends of side headers 128.

To construct the center header 176 from the blank 178, double-sided tape 208 is attached at points along the second end panel 186. First and second side panels 180 and 182, first and second end panels 184 and 186, and flap 200 are folded upwards along fold lines 192, 194, 196, and 198. Flap 200 is folded under second end panel 186 and connected thereto using tape 208. Tabs 190 are folded inward along fold lines 188.

To construct the unit 10 (FIGS. 10 and 11) from mounting brackets 12, display mounts 32, display supports 106, side headers 128, center header 176, and indicia panels 202, mounting brackets 12 with the display mounts 32 attached are attached via thumb screws 26 to a shelving unit 14. The display supports 106 are fit onto the display mounts 32 such that the end having the tab 127 is at the top opposite the display mounts 32. The tabs 127 also face inward. The center header 176 and side headers 128 are connected by inserting the ends of the side headers 128 having the short slots 170 and 172 into each end of the center header 176. Indicia panels 202 can be placed on the center header 176 and side headers 128 as desired.

The side headers 128 and center header 176 are lifted into place between the display supports 106. The tabs 127 at the top of the display supports cooperates with the long slots 174 in the side headers 128 such that the header assembly will line up with the top of the display supports 106. Additional indicia panels 202 can then be placed on the display supports 106 as desired using double-sided foam tape, or other suitable means.

While the specific embodiments have been illustrated and described, numerous modifications come to mind without significantly departing from the spirit of the invention, and the scope of protection is only limited by the scope of the accompanying Claims.

What is claimed is:

1. A display unit comprising:

a first display mount configured to be secured to a first shelving system;

a second display mount configured to be secured to a second shelving system;

a first display support attached to the first display mount;

a second display support attached to the second display mount;

a first side header attached to the first display support;

a second side header attached to the second display support;

a center header located between the first and second side headers, wherein the center header is formed from a single blank of corrugated material;

wherein the center header blank includes:

a first side panel;

a first end panel attached to the first side panel along a fold line;

a second side panel attached to the first end panel opposite the first side panel along a fold line;

a second end panel attached to the second side panel opposite the first end panel along a fold line;

at least one tab attached along a fold line to each of the first and second side panels at opposing ends; and a flap attached to the first side panel opposite the first end panel along a fold line.

2. The display unit of claim 1 further comprising a first indicia panel attached to at least one of the first and second display supports, first and second side headers, or center header.

3. The display unit of claim 1 further comprising at least one mounting bracket cooperating with each of the first and second display mounts.

4. The display unit of claim 1 wherein each of the first and second display mounts is formed from a single blank of corrugated material.

5. The display unit of claim 4 wherein each of the first and second display mount blanks includes:

a first center panel;

a second center panel joined to the first center panel along a fold line;

a bottom base panel attached to each of the first and second center panels along a fold line;

a top base panel attached to each of the bottom base panels along a fold line;

the top base panels each including first and second side panels attached thereto along a fold line;

a side panel attached to each side of the first and second center panels along a fold line;

a flap integral with each of the side panels and foldable along a fold line;

a tab at the free end of each of the top base panels;

the first and second center panels each having a generally rectangular first cutout to accept the tabs;

the first center panel including a generally rectangular second cutout; and the second center panel including a generally trapezoidal shaped cutout forming a second tab.

6. The display unit of claim 1 wherein each of the first and second display supports is formed from a single blank of corrugated material.

7. The display unit of claim 6 wherein each of the first and second display support blanks includes:

a first generally rectangular panel;

a second generally rectangular panel attached to one side of the first panel along a fold line;

a third generally rectangular panel attached to the other side of the first panel along a fold line;

a fourth generally rectangular panel attached to the second panel along a fold line; and a fifth generally rectangular panel attached to the third panel along a fold line.

8. The display unit of claim 1 wherein each of the first and second side headers is formed from a single blank of corrugated material.

9. The display unit of claim 8 wherein each of the first and side header blanks includes:

a first side panel;

a first end panel attached to the first side panel along a fold line, the first end panel including flaps attached along fold lines;

a second side panel attached to the first end panel along a fold line;

a second end panel attached to the second side panel along a fold line, second end panel including flaps attached thereto along fold lines;

a first flap attached to the first side panel opposite the first end panel along a fold line;

a second flap and a third flap attached to the first side panel at opposing ends along fold lines, the second and third flaps each having a fold line; and the first and second side panels including short cutouts, and the blank including a long cutout extending across the a portion of the first side panel, the first end panel, and a portion of the second side panel.

10. A display unit comprising:

first and second display mounts, each display mount formed from a single blank of corrugated material, wherein each of the first and second display mount blanks includes:

a first center panel, a second center panel joined to the first center panel along a fold line, a bottom base panel attached to each of the first and second center panels along a fold line, a top base panel attached to each of the bottom base panels along a fold line, the top base panels each including first and second side panels attached thereto along a fold line, a side panel attached to each side of the first and second center panels along a fold line, a flap integral with each of the side panels and foldable along a fold line, a tab at the free end of each of the top base panels, the first and second center panels each having a generally rectangular first cutout to accept the tabs, the first center panel including a generally rectangular second cutout, and the second center panel including a generally trapezoidal shaped cutout forming a second tab;

first and second display supports, the first display support attached the first display mounts, the second display support attached to the second display mount, each of the first and second display supports formed from a single blank of corrugated material;

first and second side headers, the first side header attached the first display support, the second side header attached to the second display support, each side header formed from a single blank of corrugated material; and a center header located between first and second side headers, the center header formed from a single blank of corrugated material.

11. The display unit of claim 10 wherein each of the first and second display support blanks includes:

a first generally rectangular panel;

a second generally rectangular panel attached to one side of the first panel along a fold line;

a third generally rectangular panel attached to the other side of the first panel along a fold line;

a fourth generally rectangular panel attached to the second panel along a fold line; and a fifth generally rectangular panel attached to the third panel along a fold line.

12. The display unit of claim 10 wherein each of the first and second side header blanks includes:

a first side panel;

a first end panel attached to the first side panel along a fold line, the first end panel including flaps attached along fold lines;

a second side panel attached to the first end panel along a fold line;

a second end panel attached to the second side panel along a fold line, second end panel including flaps attached thereto along fold lines;

a first flap attached to the first side panel opposite the first end panel along a fold line;

a second flap and a third flap attached to the first side panel at opposing ends along fold lines, the second and third flaps each having a fold line; and the first and second side panels including short cutouts, and the blank including a long cutout extending across the a portion of the first side panel, the first end panel, and a portion of the second side panel.

13. The display unit of claim 10 wherein the center header blank includes:

a first side panel;

a first end panel attached to the first side panel along a fold line;

a second side panel attached to the first end panel opposite the first side panel along a fold line;

a second end panel attached to the second side panel opposite the first end panel along a fold line;

at least one tab attached along a fold line to each of the first and second side panels at opposing ends; and a flap attached to the first side panel opposite the first end panel along a fold line.

14. A display unit comprising;

a first generally U-shaped mounting bracket; and a first display mount cooperating with the first bracket, the first display mount formed from a single blank of material, the blank including:

a first center panel;

a second center panel joined to the first center panel along a fold line;

a bottom base panel attached to each of the first and second center panels along a fold line;

a top base panel attached to each of the bottom base panels along a fold line;

the top base panels each including first and second side panels attached thereto along a fold line;

a side panel attached to each side of the first and second center panels along a fold line; and a flap integral with each of the side panels and foldable along a fold line.

15. The display unit of claim 14 wherein the first mounting bracket includes:

a base, the base having a horizontal portion and downward first and second vertical portions at opposing sides of the base;

the first vertical portion including a hole, the hole adapted to accommodate a thumb screws; and the second vertical portion including an inward projection at its distal end opposite the horizontal portion.

16. The display unit of claim 14 further including a second generally U-shaped mounting bracket, and the first display mount cooperating with the second mounting bracket, the second mounting bracket including a base, the base having a horizontal portion and downward first and second vertical portions at opposing sides of the base, the first vertical portion including a hole, the hole adapted to accommodate a thumb screw, and the second vertical portion including an inward projection at its distal end opposite the horizontal portion.

17. The display unit of claim 14 further comprising:

a tab at the free end of each of the top base panels;

the first and second center panels each having a generally rectangular first cutout to accept the tabs;

the first center panel including a generally rectangular second cutout; and the second center panel including a generally trapezoidal shaped cutout forming a second tab.

18. A display unit comprising;

a first mounting bracket; and a first display mount cooperating with the first mounting bracket, the first display mount formed from a single blank of material, the blank including:

a first center panel;

a second center panel joined to the first center panel along a fold line;

a bottom base panel attached to each of the first and second center panels along a fold line;

a top base panel attached to each of the bottom base panels along a fold line;

the top base panels each including first and second side panels attached thereto along a fold line;

a side panel attached to each side of the first and second center panels along a fold line; and a flap integral with each of the side panels and foldable along a fold line.

19. The display unit of claim 18 wherein the first mounting bracket is generally U-shaped and includes:

a base, the base having a horizontal portion and downward first and second vertical portions at opposing sides of the base;

the first vertical portion including a hole, the hole adapted to accommodate a thumb screws; and the second vertical portion including an inward projection at its distal end opposite the horizontal portion.

20. The display unit of claim 18 further including a second generally U-shaped mounting bracket, and a second display mount cooperating with the second mounting bracket, the second mounting bracket including a base, the base having a horizontal portion and downward first and second vertical portions at opposing sides of the base, the first vertical portion including a hole, the hole adapted to accommodate a thumb screw, and the second vertical portion including an inward projection at its distal end opposite the horizontal portion.

21. The display unit of claim 18 further comprising:

a tab at the free end of each of the top base panels;

the first and second center panels each having a generally rectangular first cutout to accept the tabs;

the first center panel including a generally rectangular second cutout; and the second center panel including a generally trapezoidal shaped cutout forming a second tab.

22. A display unit comprising:

a first display mount configured to be secured to a first shelving system;

a second display mount configured to be secured to a second shelving system;

a first display support attached to the first display mount;

a second display support attached to the second display mount;

a first side header attached to the first display support;

a second side header attached to the second display support;

a center header located between the first and second side headers;

each of the first and second display mounts is formed from a single blank of corrugated material;

wherein each of the first and second display mount blanks includes:

a first center panel;

a second center panel joined to the first center panel along a fold line;

a bottom base panel attached to each of the first and second center panels along a fold line;

a top base panel attached to each of the bottom base panels along a fold line;

the top base panels each including first and second side panels attached thereto along a fold line;

a side panel attached to each side of the first and second center panels along a fold line;

a flap integral with each of the side panels and foldable along a fold line;

a tab at the free end of each of the top base panels;

the first and second center panels each having a generally rectangular first cutout to accept the tabs;

the first center panel including a generally rectangular second cutout; and the second center panel including a generally trapezoidal shaped cutout forming a second tab.

23. A display unit comprising:

a first display mount configured to be secured to a first shelving system;

a second display mount configured to be secured to a second shelving system;

a first display support attached to the first display mount;

a second display support attached to the second display mount;

a first side header attached to the first display support;

a second side header attached to the second display support;

a center header located between the first and second side headers;

wherein each of the first and second display supports is formed from a single blank of corrugated material wherein each of the first and second display support blanks includes:

a first generally rectangular panel;

a second generally rectangular panel attached to one side of the first panel along a fold line;

a third generally rectangular panel attached to the other side of the first panel along a fold line;

a fourth generally rectangular panel attached to the second panel along a fold line; and a fifth generally rectangular panel attached to the third panel along a fold line.

24. A display unit comprising:

a first display mount configured to be secured to a first shelving system;

a second display mount configured to be secured to a second shelving system;

a first display support attached to the first display mount;

a second display support attached to the second display mount;

a first side header attached to the first display support;

a second side header attached to the second display support;

a center header located between the first and second side headers;

wherein each of the first and second side headers is formed from a single blank of corrugated material;

wherein each of the first and side header blanks includes:

a first side panel;

a first end panel attached to the first side panel along a fold line, the first end panel including flaps attached along fold lines;

a second side panel attached to the first end panel along a fold line;

a second end panel attached to the second side panel along a fold line, second end panel including flaps attached thereto along fold lines;

a first flap attached to the first side panel opposite the first end panel along a fold line;

a second flap and a third flap attached to the first side panel at opposing ends along fold lines, the second and third flaps each having a fold line; and the first and second side panels including short cutouts, and the blank including a long cutout extending across the a portion of the first side panel, the first end panel, and a portion of the second side panel.

* * * * *

UNITED STATES PATENT AND TRADEMARK OFFICE

CERTIFICATE OF CORRECTION

PATENT NO. : 8,978,280 B2
APPLICATION NO. : 13/793000
DATED : March 17, 2015
INVENTOR(S) : Douglas E. Holt et al.

It is certified that error appears in the above-identified patent and that said Letters Patent is hereby corrected as shown below:

In the Claims,

In Column 6, Line 2, in Claim 9, delete “side” and insert --second side-- therefor;

In Column 6, Line 19, in Claim 9, delete “the a” and insert --a-- therefor;

In Column 6, Line 48, in Claim 10, delete “attached” and insert --attached to-- therefor;

In Column 6, Line 52, in Claim 10, delete “attached” and insert --attach to-- therefor;

In Column 7, Line 20, in Claim 12, delete “the a” and insert --a-- therefor;

In Column 10, Line 26, in Claim 24, delete “side” and insert --second side-- therefor; and, In Column 10, Line 42, in Claim 24, delete “the a” and insert --a-- therefor.

Signed and Sealed this
Eighth Day of September, 2015

Michelle K. Lee

Michelle K. Lee
*Director of the United States Patent and Trademark Office*